US006945849B2

(12) United States Patent
Miyazawa

(10) Patent No.: US 6,945,849 B2
(45) Date of Patent: Sep. 20, 2005

(54) POLISHING METHOD AND POLISHING DEVICE

(75) Inventor: Makoto Miyazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/501,142

(22) PCT Filed: Jan. 14, 2003

(86) PCT No.: PCT/JP03/00190

§ 371 (c)(1),
(2), (4) Date: Jul. 13, 2004

(87) PCT Pub. No.: WO03/059573

PCT Pub. Date: Jul. 24, 2003

(65) Prior Publication Data

US 2005/0003742 A1 Jan. 6, 2005

(30) Foreign Application Priority Data

Jan. 15, 2002 (JP) ..... 2002-006221
Dec. 19, 2002 (JP) ..... 2002-368174

(51) Int. Cl.[7] ..... B24B 1/00; B24B 49/00; B24B 51/00

(52) U.S. Cl. ..... 451/11; 451/42; 451/504

(58) Field of Search ..... 451/11, 42, 123, 451/159, 277, 276, 384, 390, 504, 505

(56) References Cited

U.S. PATENT DOCUMENTS 5,577,950 A * 11/1996 Smith et al. ..... 451/42
5,762,546 A * 6/1998 James et al. ..... 451/504
5,951,375 A * 9/1999 Mandler ..... 451/42
6,733,369 B1 * 5/2004 Stacklies et al. ..... 451/42
6,872,120 B2 * 3/2005 Miyazawa et al. ..... 451/5
2002/0061717 A1 * 5/2002 Goulet et al. ..... 451/42

FOREIGN PATENT DOCUMENTS

| | | | |
|---|---|---|---|
| GB | 2050884 | A | 1/1981 |
| JP | 60-34261 | A | 2/1985 |
| JP | 11-77503 | A | 3/1999 |
| JP | 2001-353650 | A | 12/2001 |

* cited by examiner

*Primary Examiner*—Jacob K. Ackun, Jr.
(74) *Attorney, Agent, or Firm*—Sughrue Mion, PLLC

(57) ABSTRACT

A polishing method particularly suitable for mirror-polishing the concave surface of a lens and a polishing device, the method characterized by including the step of polishing work surfaces (50*a*, 50*b*) while allowing parts of the dome-shaped parts of elastic polishing objects (10*a*, 10*b*) matching the curved shapes of the concaved work surfaces of the works (50*a*, 50*b*) selected from among the plurality of the elastic polishing bodies having the dome-shaped parts (11*a*, 11*b*) different in curvature and larger in area than the concaved work surfaces of the works (50*a*, 50*b*) to come into contact with the generally entire surfaces of the work surfaces, wherein the curvature centers (40) of the dome-shaped parts are generally aligned with the swing centers (41) of the works, whereby the concaved work surfaces can be rapidly and uniformly polished.

9 Claims, 3 Drawing Sheets

(a)

(b)

(a)

(b)

(a)

(b)

POLISHING METHOD AND POLISHING DEVICE

TECHNICAL FIELD

The present invention relates to a polishing method and a polishing device, and particularly to a polishing method and a polishing device suitable for mirror-polishing the concave surface of a lens or the like.

BACKGROUND ART

The concave surface of a spectacle lens is formed in the shape of a spherical surface, a rotation-symmetric non-spherical surface, a toric surface, a progressive surface, or a curved surface synthesized therefrom, or the like. When the surface shape is processed by cutting or the like, the surface is mirror-polished to be an optical surface. The mirror polishing of a simple curved surface such as a spherical surface and a toric surface is conducted by fit polishing by use of a polishing dish of a rigid material called Oscar system. The mirror polishing method using the polishing dish is a method of transferring the surface shape of the polishing dish to the work (the object to be polished). Therefore, a number of processing dishes corresponding to the number of surface shapes according to the lens prescriptions, for example, thousands of processing dishes are needed.

The polishing dishes cannot be used for polishing of complicated, so-called free curved surfaces such as progressive surfaces other than these curved surfaces. Therefore, elastic polishing bodies are generally used.

For example, there has been known a partial polishing method in which a small dome-shaped elastic polishing body capable of making contact with a part of the work surface (surface to be polished of the work) is used. In the partial polishing method, the maximum curvature is determined from the shape of the work surface, a dome-shaped elastic polishing body having a curvature greater than the maximum curvature is selected, the elastic polishing body is brought into contact with a part of the work surface while being rotated, and the elastic polishing body is moved scanningly over the entire part of the work surface, whereby the entire part of the work surface is polished. Since the elastic polishing body can follow up to the shape of the work surface through deformation thereof, most of the curved surfaces can be polished by use of a single kind of elastic polishing body.

In addition, a polishing method using a balloon-type polishing body has also been known. In this method, a pressurized gas is fed into the inside of the balloon-type polishing body to inflate the balloon-type polishing body by the internal pressure. Then, the entire work surface is polished by bringing the balloon-type polishing body into contact therewith. The curvature of the balloon-type polishing body is changed to match the curved surface shape of the work. The curvature is changed by varying the internal pressure of the balloon-type polishing body, at the time of polishing. Since the balloon-type polishing body can thus follow up to the concave curved surface to be polished, it is possible to cope with a multiplicity of work surfaces by use of a single kind of balloon-type polishing body.

However, in the partial polishing method, partial polishing polishes the entire part of the work surface, which leads to a longer polishing time and a higher production cost. Besides, when it is intended to cope with various curved surfaces by controlling the shape of the elastic polishing body through regulation of the polishing pressure, pressure deficiency and/or pressure excess would be partially generated in the work surface. Therefore, polishing the entire part of the work surface at a uniform polishing pressure is difficult. Thus, it is difficult to achieve uniform polishing.

In addition, the polishing method using the balloon-type polishing body requires a shorter polishing time, because polishing is conducted by bringing the balloon-type polishing body into contact with the entire part of the work surface. However, a rise in the internal pressure may result in that the flexibility is lost, the performance of following up to the shape of the work surface is lowered, and nonuniform polishing is generated. On the other hand, when the internal pressure is lowered, the pressure of contact of the balloon-type polishing body with the work surface is lowered. The sufficient polishing may be impossible. Accordingly, the change of the curvature of the balloon-type polishing body through regulation of the internal pressure is attended by a narrow allowable range and is therefore not so effective.

The present invention has been made in consideration of the above-mentioned problems. Accordingly, it is an object of the present invention to provide a polishing method favorably following up the curvature of a concave work surface and mirror-polishing the work surface uniformly and rapidly.

It is another object of the present invention to provide a polishing device with which the polishing method of the invention can be realized.

DISCLOSURE OF INVENTION

In order to attain the above objects, the present inventor has made intensive and extensive studies. As a result of the studies, the present inventor has found out that it is effective to polish a work while allowing a part of a dome-shaped part of an elastic polishing body matching the curved shape of the concaved work surface of the work selected from among a plurality of elastic polishing bodies having dome-shaped parts different in curvature and larger in area than the concaved work surface of the work to come into contact with the generally entire surface of the work surface.

Namely, since the elastic polishing body capable of coming into contact with the generally entire part of the work surface is used, the polishing speed is high, and the polishing can be achieved rapidly. In addition, a plurality of elastic polishing bodies differing in curvature of the dome-shaped parts are prepared, and an optimum one is selected therefrom according to the curved shape of the work surface. Therefore, it is possible to favorably follow up to the work surface while minimizing the deformation amount of the elastic polishing body at the time of polishing. Therefore, the elastic polishing body makes good close contact with the work surface, and the uniform polishing can be achieved.

Besides, by setting the area of the dome-shaped part of the elastic polishing body to be larger than the area of the work surface, it is possible to enhance the circumferential speed of the rotation of the elastic polishing body and thereby to enhance the polishing speed. For uniform polishing, it is desirable to swing the rotating work surface relative to the rotating elastic polishing body. In this case, when the swing center is made to substantially coincide with the curvature center of the dome-shaped part of the elastic polishing body, the close contact between the work surface and the surface of the elastic polishing body is kept constant when the work surface swings. Therefore, the work surface and the surface of the elastic polishing body make uniform contact with each other, which promises uniform polishing.

A polishing body mount jig for holding the elastic polishing body can be provided with the function of causing the curvature center and the swing center to coincide with each other. This is possible, for example, by preparing a plurality of polishing body mount jigs differing in the height at which the elastic polishing body is held, according to the curvature of the dome-shaped part.

Furthermore, the dome-shaped part of the elastic polishing body is composed of a elastic sheet formed in a hollow dome shape and polishing is conducted while imparting a tension to the dome-shaped part by exerting a pressure to the inside surface of the elastic sheet with a pressure fluid. Thus, the regulation of the internal pressure of the elastic polishing body is added to the polishing conditions, as compared with the case where the elastic polishing body is entirely formed of an elastic material, so that appropriate polishing can be performed easily.

At the time of polishing, it is preferable to polish the work by use of a polishing pad adhered to the outside surface of the dome-shaped part of the elastic polishing body.

A polishing device is preferably so designed that, at the time of polishing, the dome-shaped elastic polishing body is rotated about its own axis while the work is rotated about its own axis and swung. In addition, the swing center and the curvature center of the elastic polishing body are made to substantially coincide with each other.

In this case, it is preferable to provide a mechanism for causing the swing center and the curvature center of the elastic polishing body to substantially coincide with each other. This is possible, for example, by preparing a plurality of jigs different in the height at which the elastic polishing body is held, according to the curvature of the dome-shaped part, as polishing body mount jigs for constituting a part of the polishing device and holding the elastic polishing body.

BEST MODE FOR CARRYING OUT THE INVENTION

Figure 1:
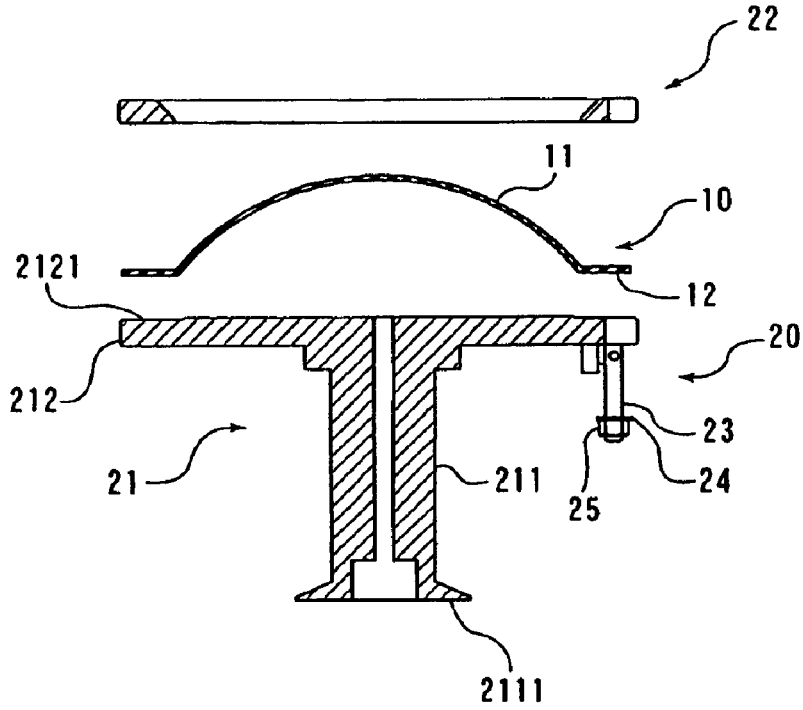
FIGS. 1(*a*) and 1(*b*) illustrate one embodiment of an elastic polishing body and a polishing body mount jig for use in the polishing method and the polishing device according to the present invention, in which FIG. 1(*a*) is a sectional view showing the individual component members in a separate state, and FIG. 1(*b*) is a top plan view showing the condition where the elastic polishing body is mounted to the polishing body mount jig.
Figure 1:
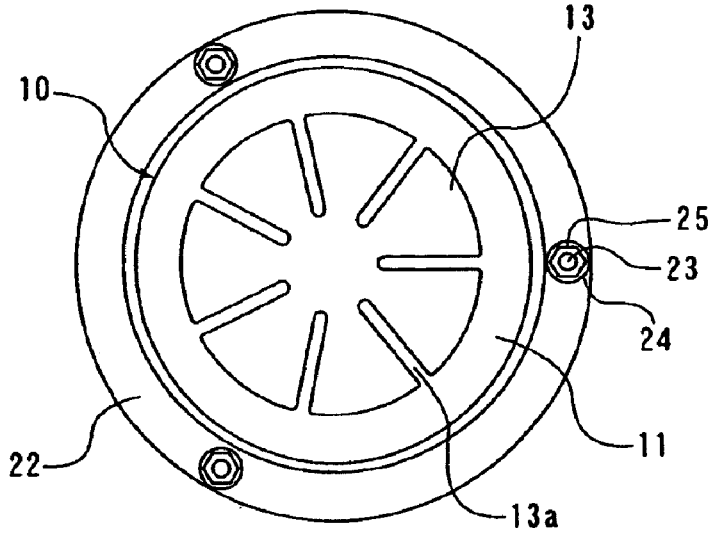

Now, embodiments of the polishing method and the polishing device according to the present invention will be described, but the present invention is not to be construed as limited to the following embodiments.

In the polishing method according to the present invention, as has been mentioned above, an elastic polishing body having a dome-shaped portion larger in area than the concaved surface to be polished (work surface) of the object to be polished (work) is used.

The work as the object of the polishing method according to the present invention is not particularly limited inasmuch as it has a concaved work surface having a comparatively small area and needing mirror polishing. Examples of the work include not only optical lenses represented by camera lenses, telescope lenses, microscope lenses, stepper condenser lenses, spectacle lenses, etc. but also glass molds for casting polymerization of plastic lenses, and optical component parts such as cover glasses for portable apparatuses. The following description will be made by taking a plastic spectacle lens as a representative of the works.

The concaved surface (on the eyeball side; referred to also as the inside surface) of a plastic spectacle lens is formed in the shape of a spherical surface, a rotation-symmetric non-spherical surface, a toric surface, a progressive surface, or a curved surface synthesized therefrom, or the like. The convex surface on the other side is composed of a spherical surface, a rotation-symmetric non-spherical surface, a progressive surface, or the like. In many cases, the shape of the concaved surface is formed by a cutting operation based on numerical control or the like. After the cutting operation, the concaved work surface must be mirror polished to be a desired optical surface.

The elastic polishing body used in the present invention must have a dome-shaped portion larger in area than the concaved work surface. This allows the polishing to be conducted while causing the dome-shaped portion to come into contact with substantially the entire surface of the work surface. In addition, the area of the dome-shaped portion of the elastic polishing body is set to be greater than the area of the work surface. Therefore, it is possible to enhance the circumferential speed of rotation of the elastic polishing body, to thereby enhance the polishing speed, and to enhance the shape follow-up performance of the elastic polishing body. It is desirable that the diameter of the dome-shaped portion of the elastic polishing body is about 1.1 to 10 times, preferably about 1.5 to 5 times, the diameter of the lens to be polished.

Examples of the dome-shaped portion include those which are formed from an elastic sheet into a hollow dome shape with the dome-like shape maintained by the internal pressure exerted by a pressure fluid, those which are formed from an elastic material into a dome-shaped block, and those in which a dome-shaped hollow portion of an elastic sheet is filled with another elastic material. The elastic sheet preferably has a thickness in the range of 0.1 to 10 mm, particularly 0.2 to 5 mm, a JIS A hardness (type A durometer) of 10 to 100, and a Young's modulus of $10^2$ to $10^3$ $N \cdot cm^{-2}$. Examples of the materials of the elastic sheet and the elastic material include rubbers such as natural rubber, nitrile rubber, chloroprene rubber, styrene-butadiene rubber (SBR), acrylonitrile-butadiene rubber (NBR), silicone rubber, fluororubber, etc., thermoplastic resins such as polyethylene, nylon, etc., and styrene-based, urethane-based or other thermoplastic resin elastomers.

Next, referring to FIGS. 1(*a*) and 1(*b*), members to be used in the polishing method according to the present invention will be described.

As shown in FIG. 1(*a*), the elastic polishing body 10 according to the present embodiment is formed from an elastic sheet. The body 10 includes a hollow dome-shaped portion 11 formed in a dome shape and a ring-shaped flange portion 12. The flange portion 12 is provided integral with the circumferential edge of the dome-shaped portion 11 and projects outwards. A polishing pad 13 formed of a nonwoven fabric or the like in the shape of flower petals as shown in FIG. 1(*b*), for example, is adhered to the outside surface of the dome-shaped portion 11 by use of a pressure sensitive adhesive or the like. The polishing pad 13 has the function of holding a polishing liquid or the like function, and gaps 13*a* in the polishing pad 13 function as passages for supply of abrasive grains and water and for discharge of chips upon polishing. Incidentally, the shape of the polishing pad 13 is not limited to the flower petal shape; for example, polishing pads blanked in a circular shape, an elliptic shape, a polygonal shape, or the like may be adhered collectively.

A polishing body mount jig 20 holds the elastic polishing body 10. The polishing body mount jig 20 functions as a conduit for introducing a pressure fluid into the elastic polishing body 10 when a sealed space is formed on the inside surface side of the elastic polishing body 10. Further, the polishing body mount jig 20 has the function of being mounted to a polishing device, which will be described later, for fixation.

The polishing body mount jig 20 includes a mount jig main body 21, and a ring-shaped presser member 22. The mount jig main body 21 includes a cylindrical tubular portion 211, and a flange-shaped polishing body mount portion 212. The polishing body mount portion 212 is provided integral with an outer circumferential portion of an upper end portion of the tubular portion 211. The polishing body mount portion 212 projects in directions orthogonal to the axis of the tubular portion 211 and is coaxial with the tubular portion 211. The polishing body mount portion 212 is provided, at an outer circumferential portion of the upper surface thereof, with a ring-shaped shallow recessed portion 2121 in which the flange portion 12 of the elastic polishing body 10 is to be contained. Cutouts (not shown) are provided at three locations at regular angular intervals from the center of the recessed portion 2121. Bolts 23 are rotatably mounted to the lower surface of the polishing body mount portion 212, and the bolts 23 can be inserted into and detached from the cutout portions. A washer 24 and a nut 25 are attached to each of the bolts 23. The flange portion 12 of the elastic polishing body 10 is also provided with cutout portions (not shown) in correspondence with the cutout portions in the polishing body mount portion 212. The presser member 22 is formed in a ring shape with a flat lower surface to be contained in the recessed portion 2121 of the polishing body mount portion 212. The presser member 22 is provided with cutout portions (not shown) corresponding to the cutout portions in the polishing body mount portion 212. A tapered mount portion 2111 to be mounted to the polishing device, for fixation, is provided at a lower end portion of the tubular portion 211, in the state of projecting outwards.

The flange portion 12 of the elastic polishing body 10 is mounted in the recessed portion 2121 of the polishing body mount portion 212, with the cutout portions of them matching each other, to fix the elastic polishing body 10 to the polishing body mount jig 20. Further, the presser member 22 is mounted on the flange portion 12 of the elastic polishing body 10, with the cutout portions of them matching each other. Then, the bolts 23 are erected and inserted into the cutout portions, and the nuts 25 are fastened. Thus, the flange portion 12 of the elastic polishing body 10 can be fixed in the state of being clamped between the polishing body mount portion 212 and the presser member 22, as shown in FIG. 1(*b*). As a result, a dome-shaped sealed space is formed between the inside surface of the dome-shaped portion 11 and the upper surface of the polishing body mount portion 212, and the sealed space is communicated with the exterior through the void in the tubular portion 211.

The polishing method according to the present invention is carried out by preparing a plurality of the elastic polishing bodies 10 differing in the curvature of the dome-shaped portion 11, selecting the elastic polishing body 10 having the dome-shaped portion 11 matching the curved shape of the work surface from among the plurality of the elastic polishing bodies 10 prepared, and polishing the work surface while allowing a part of the dome-shaped portion 11 of the elastic polishing body 10 selected to come into contact with substantially the entire surface of the work surface.

Next, referring to FIGS. 2(*a*) and 2(*b*), one embodiment of the polishing method according to the present invention as above-described will be described.

In the present embodiment, the polishing body mount jigs 20 for exclusive use with the elastic polishing bodies 10 differing in the curvature of the dome-shaped portion 11 are prepared on the basis of each of the elastic polishing bodies 10.

Figure 2:
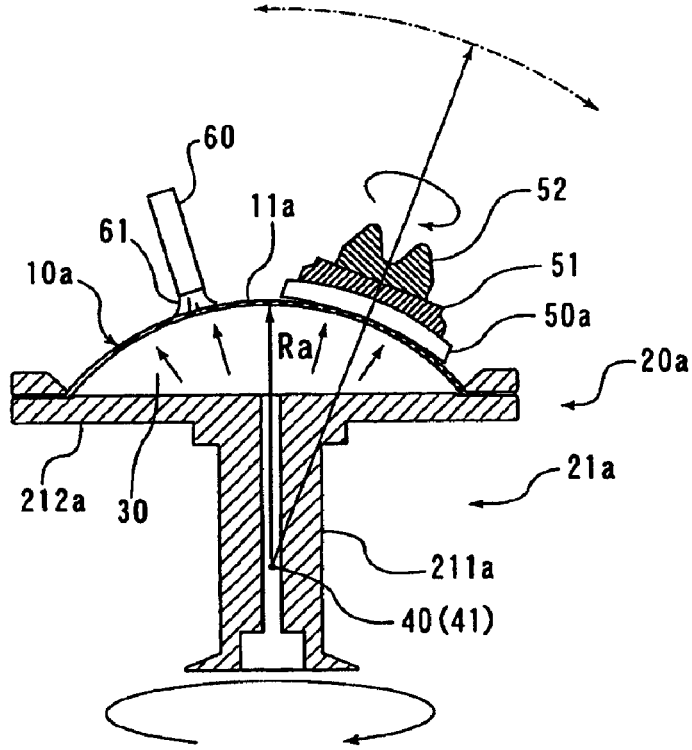
FIGS. 2(*a*) and 2(*b*) show sectional views illustrating one embodiment of the polishing method according to the present invention, in which FIG. 2(*a*) shows an example of an elastic polishing body having a small curvature, and FIG. 2(*b*) shows an example of an elastic polishing body having a large curvature.
Figure 2:
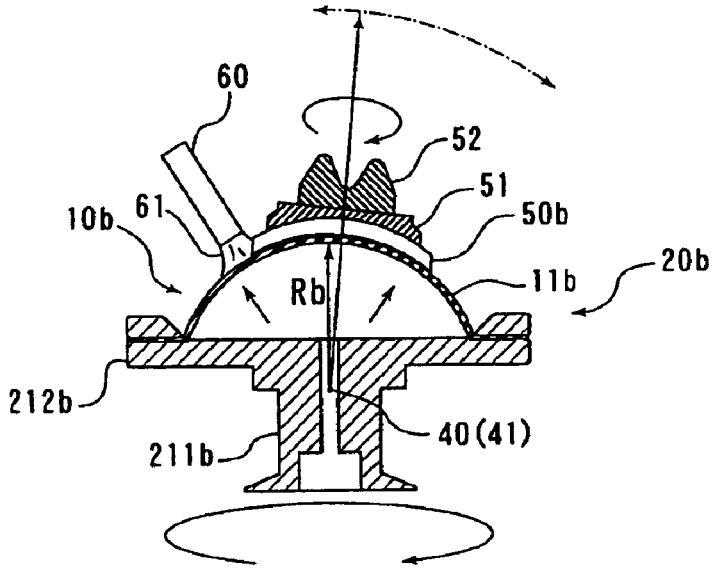

As shown in FIG. 2(*a*), an elastic polishing body 10*a* having a small curvature (the radius of curvature, Ra, is large), for example, is mounted to a turntable of a polishing device (described later) through a polishing body mount jig 20*a*. Compressed air at a predetermined pressure is fed into the sealed space 30 between the inside surface of the dome-shaped portion 11*a* and the polishing body mount portion 212*a*. Therefore, the sealed space 30 maintains the predetermined pressure and imparts a tension to the dome-shaped portion 11*a*. In this instance, the curvature center 40 of the dome-shaped portion 11*a* is present on the center axis of the tubular portion 211*a*. In addition, the elastic polishing body 10*a* is rotated with the center axis of the tubular portion 211*a* of the polishing body mount jig 20*a* as a rotational axis, i.e., with the line connecting between the curvature center 40 of the dome-shaped portion 11*a* and the top of the dome-shaped portion 11*a* substantially as the rotational axis.

On the other hand, the concaved work surface of the work 50*a* has a small curvature, which is close to the curvature of the dome-shaped portion 11*a* of the elastic polishing body 10*a*, so that the outside surface of the elastic polishing body 10*a* is in close contact with the substantially entire surface of the concaved surface of the work 50*a*. A work mount portion 52 fixed by being mounted to a chuck of the polishing device through a bonding material 51 is joined to the surface, opposite to the side of the concaved work surface of the work 50*a*. The bonding material 51 is, for example, a low melting point metal or a wax. The chuck (not shown) of the polishing device is driven to rotate, whereby the work 50*a* is rotated about its own axis at a predetermined rotating speed. In addition, the chuck is supplied, for example, with an air pressure so that the work 50*a* can be pressed against the elastic polishing body 10 at a predetermined polishing pressure. Furthermore, the chuck supporting the work 50*a* in the polishing device effects a swinging motion. The rotational axis of the work 50*a* is reciprocated between the vicinity of the top of the dome-shaped portion 11*a* and the end portion side of the dome-shaped portion 11*a*. In the polishing method according to the present invention, the swing center 41 of the swinging motion coincides substantially with the curvature center 40 of the elastic polishing body. It is ensured that the rotational axis of the chuck supporting the work 50*a* always passes through the swing center 41.

Besides, the dome-shaped portion 11*b* of an elastic polishing body 10*b* shown in FIG. 2(*b*) is selected to have a large curvature (the radius of curvature, Rb, is small) close to the curvature of the concaved work surface having a large curvature of a work 50*b*. Therefore, the outside surface of the elastic polishing body 10*b* makes close contact with the substantially entire surface of the concaved surface of the work 50*b*. Also when the elastic polishing body 10*b* is mounted to the polishing body mount portion 212*b* of a polishing body mount jig 20*b*, the swing center 41 of the swinging motion of the work 50*b* coincides substantially with the curvature center 40 of the elastic polishing body 10*b*. Specifically, as shown in FIGS. 2(*a*) and 2(*b*), the lengths of the tubular portions 211*a*, 211*b* of the polishing body mount jigs 20*a*, 20*b* are set, and the heights at which the elastic polishing bodies 10*a*, 10*b* are held are changed vertically. Therefore, the curvature centers 40 of the dome-shaped portions 11*a*, 11*b* always coincide with the swing centers 41, when the polishing body mount jigs 20*a*, 20*b* are mounted on the polishing device.

In the case of polishing the inside surfaces of spectacle lenses, the plurality of elastic polishing bodies 10 differing in the curvature of the dome-shaped portion 11 have radii of curvature, R, of for example in the range of 40 to 600 mm; about five to ten radii of curvature, R, are prepared at an increment of 10 to 40 mm, preferably at an increment of 14 to 30 mm, in the R range of up to 200 mm, and at an increment of 100 to 200 mm in the R range of 200 to 600 mm. This makes it possible to cope with the curved inside surfaces based on substantially all the prescriptions.

As a method for selecting an elastic polishing body having a curvature matching the curved shape of the work surface from among the plurality of elastic polishing bodies 10 differing in curvature, $(R_{max}+R_{min})/2=R_{mid}$ is determined from the maximum radius of curvature, $R_{max}$, and the minimum radius of curvature, $R_{min}$, which are present in the inside surface of the lens, and an elastic polishing body 10 having a radius of curvature close to the middle radius of curvature, $R_{mid}$, is selected. By this selecting method, $R_{max}=R_{min}$ is established in the case of a spherical surface or an axially symmetric non-spherical surface, and an elastic polishing body having an appropriate curvature can be selected. In the case of an astigmatism surface (toric surface), the radius of curvature corresponds to the middle between a base curve and a cross curve. In this way, the dome-shaped portion can close contact with the cylindrical toric surface with a favorable follow-up performance while minimizing the deformation of the elastic polishing body. The astigmatism surface is possible to achieve uniform polishing. In the cases of other curved surfaces than the toric surface, for example, in the cases of progressive surfaces and curved surfaces synthesized from a progressive surface and a toric surface, the curved surface is approximated to a toric surface and a dome-shaped portion 11 having a radius of curvature close to the radius of curvature $R_{mid}$ at the middle between the base curve and the cross curve of the approximated toric surface is selected. The dome-shaped portion can be brought into close contact with the curved surface of the work surface with a favorable follow-up performance while minimizing the deformation of the elastic polishing body. In the polishing method according to the present invention, although replacing the elastic polishing body according to the work surface is troublesomeness, the number of the elastic polishing bodies for selection is much smaller, as compared with the case of using hard polishing dishes.

At the time of polishing, as shown in FIGS. 2(*a*) and 2(*b*), the elastic polishing body 10*a*, 10*b* with a polishing pad 13 adhered to the surface thereof is rotated about its own axis at a predetermined rotating speed while imparting a tension thereto by use of a predetermined internal pressure. In this condition, the work 50*a*, 50*b* is pressed against the elastic polishing body 10*a*, 10*b* at a predetermined polishing pressure while rotating the work 50*a*, 50*b* at a predetermined rotating speed with the axis passing through the curvature center (swiveling center) 40 as a rotational axis. The work 50*a*, 50*b* is put into a swinging motion, and a slurry 61 containing an abrasive is supplied from a nozzle 60 onto the surface of the elastic polishing body 10*a*, 10*b*. Under this condition, the polishing is conducted.

In this case, the polishing can be conducted under the polishing conditions of an internal pressure exerted on the elastic polishing body 10*a*, 10*b* of, for example, 0.2 to 1.2 kgf/cm$^2$, a rotating speed of the elastic polishing body 10*a*, 10*b* of, for example, 50 to 500 rpm/min, a rotating speed of the work 50*a*, 50*b* of, for example, 1 to 30 rpm/min, a swinging speed of, for example, 1 to 20 reciprocations/min, and a polishing pressure of, for example, 3 to 30 kgf/cm$^2$.

According to the polishing method as above-described, the surface of the dome-shaped portion 11*a*, 11*b* larger than the work 50*a*, 50*b* can be effectively utilized, by the effect of the swinging motion of the work 50*a*, 50*b*. This promises a high polishing speed, together with the simultaneous polishing of the substantially entire surface of the work surface. In this method, the swing center 41 at the time of the swinging motion coincides substantially with the curvature center 40 of the dome-shaped portion 11*a*, 11*b* of the elastic polishing body 10*a*, 10*b*. The relative distance between the work surface and the elastic polishing body 10*a*, 10*b* is kept constant. Thus, the work surface always makes uniform contact with the surface of the elastic polishing body 10*a*, 10*b*, and the uniform polishing can be achieved.

Figure 3:
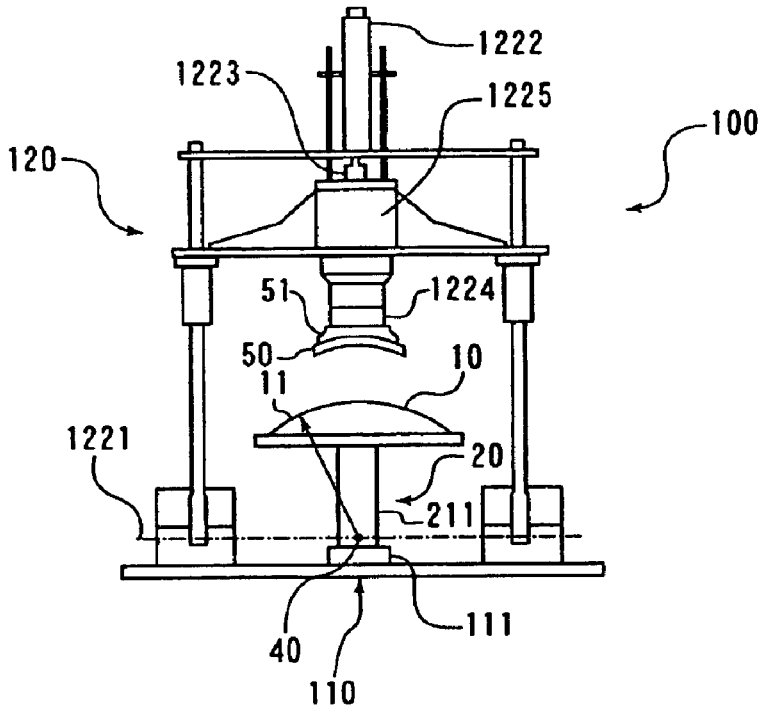
FIGS. 3(*a*) and 3(*b*) illustrate one embodiment of the polishing device according to the present invention, in which FIG. 3(*a*) is a front view, and FIG. 3(*b*) is a side view.
Figure 3:
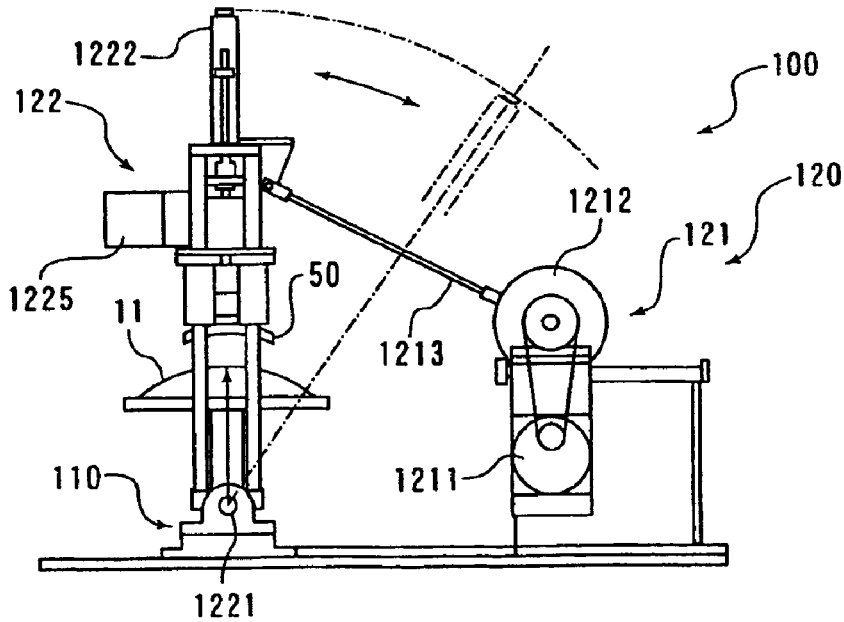

Next, referring to FIGS. 3(*a*) and 3(*b*), a polishing device with which the polishing method according to the present invention can be realized will be described.

The polishing device 100 includes a polishing body holding and driving unit 110, a polishing body mount jig 20, and a work holding and driving unit 120. A turntable 111 driven to rotate about a vertical axis by a motor (not shown) is provided as the polishing body holding and driving unit 110. A mount portion 2111 at the lower end of a tubular portion 211 of the polishing body mount jig 20 is mounted and fixed to the turntable 111. With the polishing body mount jig 20 mounted to the turntable 111, the polishing body mount jig 20 can be rotated at a predetermined rotating speed with the center axis of the tubular portion 211 of the polishing body mount jig 20 as a rotational axis, i.e., with the line connecting between the curvature center 40 of the dome-shaped portion 11 of the elastic polishing body and the top of the dome-shaped portion 11 substantially as the rotational axis. In addition, the turntable 111 is provided with a piping for compressed air (not shown), and the piping is connected to the hollow portion of the tubular portion 211.

Besides, a swinging driving device 121 and a work holding device 122 swung by the swinging driving device 121 are provided as the work holding and driving unit 120. The swinging driving device 121 drives a crank 1212 rotated through belt transmission by a motor 1211, and swings the work holding device 122 connected to the crank 1212 through a connecting rod 1213. The work holding device 122 can swing in the front-rear direction between the vertical direction and a rear inclination angle, with a swing shaft 1221 as a center. The work holding device 122 includes an air cylinder 1222 directed vertically downwards at an upper portion thereof. A chuck 1224 to which the work mount portion 52 is mounted and fixed is provided at the tip end of a piston rod 1223 of the air cylinder 1222. The chuck 1224 is driven to rotate by a motor 1225, with an axis passing through the intersection between the swing shaft 1221 and the center axis of the tubular portion 211 of the polishing body mount jig 20 as a rotational axis. The work mount portion 52 integrated with the work 50 through the bonding material 51 is mounted to the chuck 1224, whereby the work 50 can be mounted to the work holding device 122. The work 50 thus mounted can be spaced away from and brought closer to the elastic polishing body 10 by the air cylinder 1222. Further, the work 50 is pressed against the elastic polishing body 10 at a predetermined polishing pressure by the air cylinder 1222.

In this polishing device 100, when the polishing body mount jig 20 having the tubular portion 211 with a length according to the curvature of the dome-shaped portion 11 of the elastic polishing body 10 is mounted to the turntable 111, the holding position for the elastic polishing body 10 differs depending on the polishing body mount jig 20. Therefore, the curvature center 40 of the dome-shaped portion 11 of the elastic polishing body 10 coincides substantially with the center of the swing shaft 1221.

At the time of polishing, for example, the concaved surface of a lens as the work 50 by use of the polishing device 100 as above-described, the elastic polishing body 10 with the polishing pad 13 adhered to the surface thereof is rotated about its own axis at a predetermined rotating speed by the turntable 111 while imparting a predetermined internal pressure thereto through pressure regulation of compressed air. In this condition, the work 50 is pressed against the elastic polishing body 10 at a predetermined polishing pressure of the air cylinder 1222 while rotating the work 50 about its own axis at a predetermined rotating speed. Further, the work 50 is put into a swinging motion by the swinging driving device 121, and a slurry containing an abrasive is supplied from a nozzle (not shown) onto the surface of the elastic polishing body 10. Under this condition, the polishing is conducted.

The polishing device 100 as above-described is so designed to achieve uniform and rapid polishing by the swinging motion of the work 50, which allows effective utilization of the surface of the elastic polishing body 10. The curvature center of the dome-shaped portion 11 of the elastic polishing body 10 is always made to coincide substantially with the swing center 1221 of the work by the polishing body mount jig 20, even when the curvature of the dome-shaped portion 11 varies.

The polishing body mount jig having the tubular portion with a specified length according to the curvature of the dome-shaped portion is prepared for exclusive use with each elastic polishing body in the above description. The polishing body mount jig is for the purpose of allowing the swing center and the curvature center to coincide with each other. However, other systems can also be adopted; for example, the length of the tubular portion may be variable, or the height of the turntable in the polishing device may be vertically changed according to the curvature of the dome-shaped portion.

As has been described above, according to the polishing method of the present invention, the substantially entire surface of the concaved work surface is polished by selecting the elastic polishing body suited to the concaved curved surface, whereby the polishing can be performed rapidly and uniformly.

In addition, the polishing device according to the present invention can realize the above-described polishing method and polish the concaved work surface rapidly and uniformly.

Industrial Applicability

The polishing method according to the present invention can be utilized, for example, for production of spectacle lenses by applying the method to mirror polishing of the concaved surfaces of the spectacle lenses.

The polishing device according to the present invention can be utilized, for example, for mirror polishing of the concaved surfaces of spectacle lenses.

What is claimed is:

1. A polishing method characterized by comprising the step of polishing a work while allowing a part of a dome-shaped portion of an elastic polishing body matching the curves shape of a concaved work surface of said work selected from among a plurality of said elastic polishing bodies having said dome-shaped portions different in curvature and larger in area than said concaved work surface of said work to come into contact with the generally entire surface of said work surface.

2. The polishing method as set forth in claim 1, wherein the polishing is conducted by causing the curvature center of said dome-shaped portion to coincide substantially with the swing center of said work while putting said work into a swinging motion and a rotating motion and putting said elastic polishing body into a rotating motion.

3. The polishing method as set forth in claim 2, wherein a polishing body mount jig for holding said elastic polishing body and for causing the curvature center of said dome-shaped portion to coincide substantially with the swing center of said work when mounted to a polishing device is used.

4. The polishing method as set forth in claim 3, wherein said polishing body mount jig includes a plurality of kinds of polishing body mount jigs different in the height at which said elastic polishing body is held, according to the curvatures of said dome-shaped portions of said elastic polishing bodies.

5. The polishing method as set forth in claim 1, wherein said dome-shaped portion of said elastic polishing body is composed of a elastic sheet formed in a hollow dome shape, and the polishing is conducted while exerting a pressure on the inside surface of said elastic sheet and thereby imparting a tension to said dome-shaped portion.

6. The polishing method as set forth in claim 1, wherein said work is polished with a polishing pad adhered to the outside surface of said dome-shaped portion.

7. A polishing device comprising a work holding and driving unit for holding a work and putting said work into a rotating motion and a swinging motion, a polishing body mount jig for holding an elastic polishing body having a dome-shaped portion, and a polishing body holding and driving unit to which said polishing body mount jig is detachably mounted and which rotates said elastic polishing body through said polishing body mount jig while causing the swing center of said work holding and driving unit to coincide substantially with the curvature center of said dome-shaped portion.

8. The polishing device as set forth in claim 7, wherein the holding position for said elastic polishing body can be changed according to the curvature of said dome-shaped portion of said elastic polishing body, and the curvature center of said dome-shaped portion can be made to coincide substantially with said swing center.

9. The polishing device as set forth in claim 8, wherein the change of said holding position for said elastic polishing body is performed by a change among a plurality of kinds of said polishing body mount jigs different in the height at which said elastic polishing body is held, according to the curvature of said dome-shaped portion of said elastic polishing body.

* * * * *